US005319429A

United States Patent [19]

Fukuchi et al.

[11] Patent Number: 5,319,429

[45] Date of Patent: Jun. 7, 1994

[54] COLOR IMAGE FORMING APPARATUS USING FIXING APPARATUS FOR GLOSSY IMAGES

[75] Inventors: Masakazu Fukuchi; Shizuo Morita; Satoshi Haneda; Hisao Satoh; Tadayoshi Ikeda, all of Hachioji, Japan

[73] Assignee: Konica Corporation, Tokyo, Japan

[21] Appl. No.: 977,823

[22] Filed: Nov. 17, 1992

[30] Foreign Application Priority Data

Nov. 20, 1991 [JP] Japan ..... 3-305072

[51] Int. Cl.[5] ..... G03G 15/20

[52] U.S. Cl. ..... 355/290; 219/216

[58] Field of Search ..... 355/282, 285, 289, 290; 219/216, 469

[56] References Cited

U.S. PATENT DOCUMENTS

| | | | |
|---|---|---|---|
| 4,242,566 | 12/1980 | Scribner | 219/216 |
| 4,892,994 | 1/1990 | Tsuchiya et al. | 219/216 |
| 4,905,053 | 2/1990 | Matsuo et al. | 355/319 |
| 4,931,618 | 6/1990 | Nagata et al. | 219/216 |
| 5,099,288 | 3/1992 | Britto et al. | 355/290 |
| 5,164,782 | 11/1992 | Nagayama et al. | 355/285 |

FOREIGN PATENT DOCUMENTS

| | | | |
|---|---|---|---|
| 0101850 | 5/1988 | Japan | 355/285 |
| 0090477 | 4/1989 | Japan | 355/285 |
| 0072376 | 3/1990 | Japan | 355/290 |
| 0072383 | 3/1990 | Japan | 355/289 |
| 0162383 | 6/1990 | Japan | 355/290 |
| 0076546 | 3/1992 | Japan | 355/285 |

*Primary Examiner*—A. T. Grimley
*Assistant Examiner*—Robert Beatty
*Attorney, Agent, or Firm*—Frishauf, Holtz, Goodman & Woodward

[57] ABSTRACT

A color image forming machine such as a copier or a printer for producing a toner image, corresponding to an original image, on a recording sheet. The color image forming machine has a photoreceptor for forming the toner image on its surface; a transferrer for transferring the toner image from the photoreceptor to the recording sheet; and a fixer for fixing the toner image on the recording sheet. The fixer includes (1) an endless heat belt which is supported by a heat roller and a separation roller; and (2) an endless conveyance belt which is supported by a pressure roller and another separation roller; in which the endless heat belt and the endless conveyance belt are partially pressed together by the first pair which are inclined relative to one another, and the second pair so that a nip region is created between the first pair of rollers and the second pair of rollers. The endless heat belt and the endless conveyance belt have a glossy surface. The fixer conveys the recording sheet upwards in the apparatus when the fixer fixes the toner image on the recording sheet.

7 Claims, 15 Drawing Sheets

FIG. 3

| COPYING MODE | DISCHARGE | ANGLE OF THE CONTROLLED GUIDE PLATE (SHOWN IN FIG. NUMBERS) |
|---|---|---|
| ONE-SIDE COPY | FACE DOWN | FIG. 2(a) |
| | FACE UP | FIG. 2(c) |
| MULTIPLE COPY | FACE DOWN | FIG. 2(b) → FIG. 2(a) |
| | FACE UP | FIG. 2(b) → FIG. 2(c) |
| BOTH-SIDE COPY | FACE DOWN | FIG. 2(c) → FIG. 2(a) |
| | FACE UP | FIG. 2(c) → FIG. 2(a) → FIG. 2(c) |

COLOR IMAGE FORMING APPARATUS USING FIXING APPARATUS FOR GLOSSY IMAGES

BACKGROUND OF THE INVENTION

The present invention relates to a color image forming apparatus in which: a color toner image is formed on a photoreceptor by means of electrophotography; the color toner image is transferred onto a transfer sheet; and the transferred image is thermally fixed to obtain a color image on the transfer sheet. More particularly, the present invention relates to a color image forming apparatus that can form a color image of high quality on one or both surfaces of a transfer sheet.

A large number of electrophotographic color image forming methods and apparatus are known. For example, the following color image forming method is disclosed in Japanese Published Application No. 100770/1986: Latent images, the number of which is the same as the number of separated colors, are formed and developed on the surface of a photoreceptor drum. Each time the latent image is developed, the image is transferred onto the surface of a transfer drum to form a multicolor image on the transfer drum. After that, the image is transferred onto a transfer paper to obtain a color image.

Another multicolor image forming method is disclosed in Japanese Published Application No. 149972/1986. According to the aforementioned method, a color image is formed as follows: Latent images, the number of which is the same as the number of separated colors, are formed and developed on the surface of a photoreceptor drum. Each time the latent image is developed, the image is transferred onto the surface of a transfer sheet to obtain a multicolor image.

Further, there is a color image forming method by which color images are formed in the following manner: Latent images, the number of which is the same as the number of separated colors, are formed and developed by color toners on the surface of a photoreceptor drum so that color toner images are superimposed on the photoreceptor drum.

The fundamental process of this multicolor image formation is disclosed in Japanese Published Application Nos. 75850/1985, 76766/1985, 95456/1985, 95458/1985 and 158475/1985.

In the case of a multicolor image forming apparatus that forms a color image by superimposing color toner images, operations are carried out to obtain a color image as follows: A plurality of developing units provided with toners of different colors are disposed around a photoreceptor drum. In general, the photoreceptor drum is rotated a plurality of times so that a latent image on the photoreceptor drum can be developed.

Concerning the image forming body, apart from the aforementioned photoreceptor drum, the circumferential surface of which is coated or vapor-deposited with a photoconductor, there is also a belt-shaped image forming body that is composed in such a manner that a flexible belt is coated or vapor-deposited with a photoconductor. This belt-shaped image forming body (referred to as a photoreceptor belt, hereinafter) can be provided between rotational rollers including a drive roller, so that space can be effectively utilized and a compact color image forming apparatus can be provided. Since the photoreceptor belt can be moved around a small radius of curvature, a transfer sheet can be separated from the photoreceptor belt utilizing a portion of the photoreceptor belt, the radius of curvature of which is small, wherein a rotational roller of a small diameter is used to form the portion of the small radius of curvature. Therefore, the occurrence of defective separation of a transfer sheet can be avoided.

Image formation is carried out by the apparatus shown in FIG. 19 to which the aforementioned photoreceptor belt is applied. FIG. 19 is a schematic illustration showing the structure of a conventional color image forming apparatus.

A photoreceptor belt 1 is wrapped around rotational rollers 2 and 3 and tension roller 5, and when the rotational roller 2 is driven in the arrowed direction, the photoreceptor belt 1 is conveyed clockwise in contact with guide member 4. Between a cleaning unit 13 (having a blade 13A and a cleaning roller 13B) on the right and a transfer unit 12 on the left, there are provided a charging unit 6, an exposure section composed of a laser writing system unit 7 (having a drive motor 7A, polygonal mirror 7B, $f\theta$ lens 7C, and mirrors 7D and 7E), and four developing units 8 to 11 accommodating four kinds of color developers. When charging, exposing and developing operations are conducting on the photoreceptor belt 1 four times, a color toner image is formed, and the formed color toner image is transferred onto a transfer sheet by the transfer unit 12. The transfer sheet is sent from sheet cassette 14 through sheet guide 15 and timing roller 17 when supply roller 16 is rotated. After the transfer operation has been completed, the photoreceptor belt 1 is cleaned by the cleaning unit 13, and the subsequent image is formed by the same process as described above. The image formed on the transfer sheet is fixed by a fixing roller 18, and then the transfer sheet is discharged onto a tray mounted on an upper cover 20 through a discharging roller 19.

In the manner described above, a full color image can be provided. The quality of this full color image greatly depends on the fixing operation.

A heat roller fixing system is most generally applied to the fixing process for toner images in electrophotography. In the recent electrophotographic process by which color images are formed, it is required to fuse and cool a toner image sufficiently in order to ensure color reproduction properties and gloss of the image. Therefore, the belt type fixing system, that can fuse and cool toner images better than the heat roller fixing system, is applied to the color image forming apparatus.

A thermal fixing unit in which toner images are fixed through a thermal belt is disclosed in Japanese Published Application No. 36342/1974. In this unit, a press roller is brought into contact with a heat roller through a belt, and when a transfer sheet, on which a toner image is formed, is pinched between the press roller and the thermal belt, the toner image is fixed.

Japanese Published Application No. 122665/1986 also discloses a fixing unit in which toner images are thermally fixed through a belt.

Further, Japanese Published Application No. 706331974/1986 also discloses a fixing unit in which the fixing operation is carried out as follows: Two endless belts are provided between a heat roller disposed at the entry side and a cooling roller disposed at the delivery side. Flat portions of both belts run in parallel, and a transfer sheet on which a toner image has been formed, is pinched by the two belts so that it is conveyed from the entry side to the delivery side.

In the same manner as the image formation of monocolor, color images can be formed on either surface of a transfer sheet, i.e. they can be formed on one side or on both sides of the transfer sheet.

In an automatic two-sided recording apparatus of the prior art, images are recorded on both sides of a transfer sheet in the following manner: After an image has been formed on one side of a transfer sheet in an image processing section, the transfer sheet is temporarily stored in a middle portion, and this transfer sheet is conveyed again to the image forming section so that an image is formed on the other side of the transfer sheet. As a result of the foregoing, images can be recorded on both sides of the transfer sheet.

As mentioned before, in the case of full color image formation, the fixing process has great influence on the quality of an image. For that reason, the belt type fixing system that can fuse and cool a toner image better than the heat roller type fixing system, has come into wide use for a color image forming apparatus.

As disclosed in Japanese Published Application No. 36342/1974, the fixing unit is provided with a press roller that is pressed against a heat roller through a belt, and a transfer sheet, on which a toner image has already been formed, is pinched between the press roller and the belt so that the toner image can be fixed. However, in the aforementioned structure of the prior art, not enough nip region can be provided, so that sufficient heat cannot be supplied from the upper heat roller through the belt. Accordingly, the toner cannot be fused sufficiently for the fixed image to become glossy.

In the case of the fixing unit disclosed in Japanese Published Application No. 122665/1986 in which fixing is carried out through a belt, nip region formed by the press roller and the belt is not sufficiently long, so that sufficient fusing time cannot be provided and the transfer sheet cannot be heated sufficiently. As a result, the fixing property is influenced by the material and thickness of the transfer sheet. Therefore, the thermal fixing operation becomes unstable.

In the case of the fixing unit disclosed in Japanese Published Application No. 70633/1874, the fixing operation is carried out as follows: Two endless belts are provided between a heat roller disposed at the entry side and a cooling roller disposed at the delivery side. Flat portions of both belts run in parallel, and a transfer sheet on which a toner image has been formed is pinched by the two belts so that it is conveyed from the entry side to the delivery side.

When the surfaces of the heat roller and press roller are hard, the endless belt can be regarded as hard. When a transfer sheet on which a toner image has been formed is conveyed between the rollers, contact pressure is given onto a very narrow portion. Therefore, the transfer sheet is fluctuated due to the vibration of the rollers. Accordingly, a different part of the transfer sheet experiences a different thermal expansion. As a result of the foregoing, the transfer sheet is wrinkled.

On the other hand, a conventional automatic two-sided recording apparatus is arranged in the following manner: After an image has been formed on one side of a transfer sheet in an image processing section, the transfer sheet is temporarily stored in a middle portion, and this transfer sheet is conveyed again to the image forming section so that an image is formed on the other side of the transfer sheet. As a result of the foregoing, images can be recorded on both sides of the transfer sheet.

As can be seen from the foregoing, the structure of the conventional automatic two-sided recording apparatus is complicated, because the passage for transfer sheets is long and complicated. Therefore, the conventional automatic two-sided recording apparatus is disadvantageous in that jamming of transfer sheets tends to occur. The aforementioned complicated passage is provided in the lower center of the main mechanism of the image forming apparatus, so that the entire structure becomes further complicated, and the cost is increased. Further, in the case of the occurrence of jamming, it is difficult to clear a jammed transfer sheet.

The present invention has been designed to solve the aforementioned problems. It is a primary object of the present invention to provide a simple color image forming apparatus of low cost that can easily record an image of high quality onto one side of a transfer sheet or both sides of a transfer sheet, and the image forming apparatus of the invention can form an image of high quality in such a manner that: the image quality is not affected by the material or thickness of a transfer sheet; wrinkles are not caused on the transfer sheet; and the occurrence of offset is avoided.

SUMMARY OF THE INVENTION

The aforementioned object can be accomplished by a color image forming apparatus having a fixer to fix a toner image on the surface of a transfer sheet after transfer of the toner image, and a conveyer to reverse the transfer sheet after fixing so that a toner image can be transferred onto the reverse side of the transfer sheet. The fixer is provided with an upper endless heat belt which is provided around an inner heat roller and a separation roller and also provided with a lower endless conveyance belt which is provided around a pressure roller and a separation roller, said pressure roller being pressed to said inner heat roller through both endless belts, the two separation rollers being pressed to each other through both endless belts, the surfaces of both endless belts being glossy so that the fixing surface of the transfer sheet can become glossy. The conveyer is provided with a sheet feed cassette disposed in a lower position, and the transfer sheet on which an image has been forced is discharged upward. After the transfer sheet has been moved from upward to downward toward a two-side unit, provided opposite the image forming section, the transfer sheet is supplied from the two-side unit which is located at the side opposite to the sheet feed unit so as to form an image.

The aforementioned object can be also accomplished by a color image forming apparatus provided with a fixing device in which: the first nip region is formed by the heat and pressure rollers; and the second nip region is formed by pressing a pushing guide member to the inside of the endless belt on the heat roller.

The aforementioned object can be also accomplished by a color image forming apparatus provided with a fixing device in which: the first nip region is formed by the heat and pressure rollers; and the second nip region is formed by pressing a pushing guide member to the inside of the endless pressure belt on the pressure roller.

The aforementioned object can be accomplished by a color image forming apparatus provided with a fixing device in which: a straight line connecting the axial centers of the heat roller and pressure roller is inclined by 15° to 40° with regard to the vertical line so that the pressure roller can be located on the upstream side of the heat roller to form the first and second nip regions.

The aforementioned object can be also accomplished by a color image forming apparatus provided with a fixing device in which: a straight line connecting the axial centers of the heat roller and pressure roller is inclined by 15° to 40° with regard to the vertical line so that the pressure roller can be located on the downstream side of the heat roller to form the first and second nip regions.

The aforementioned object can be also accomplished by a color image forming apparatus, the fixing device of which is provided with: the first nip region formed by the heat and pressure rollers; and the second nip region formed by the pressure roller or heat roller in an overlapping portion of the endless heat belt and endless pressure belt.

BRIEF DESCRIPTION OF THE DRAWINGS

FIG. 3 is a schematic illustration showing the contents of copy modes carried out by the transfer sheet conveyance means shown in FIG. 1;

DETAILED DESCRIPTION OF THE INVENTION

Figure 1:
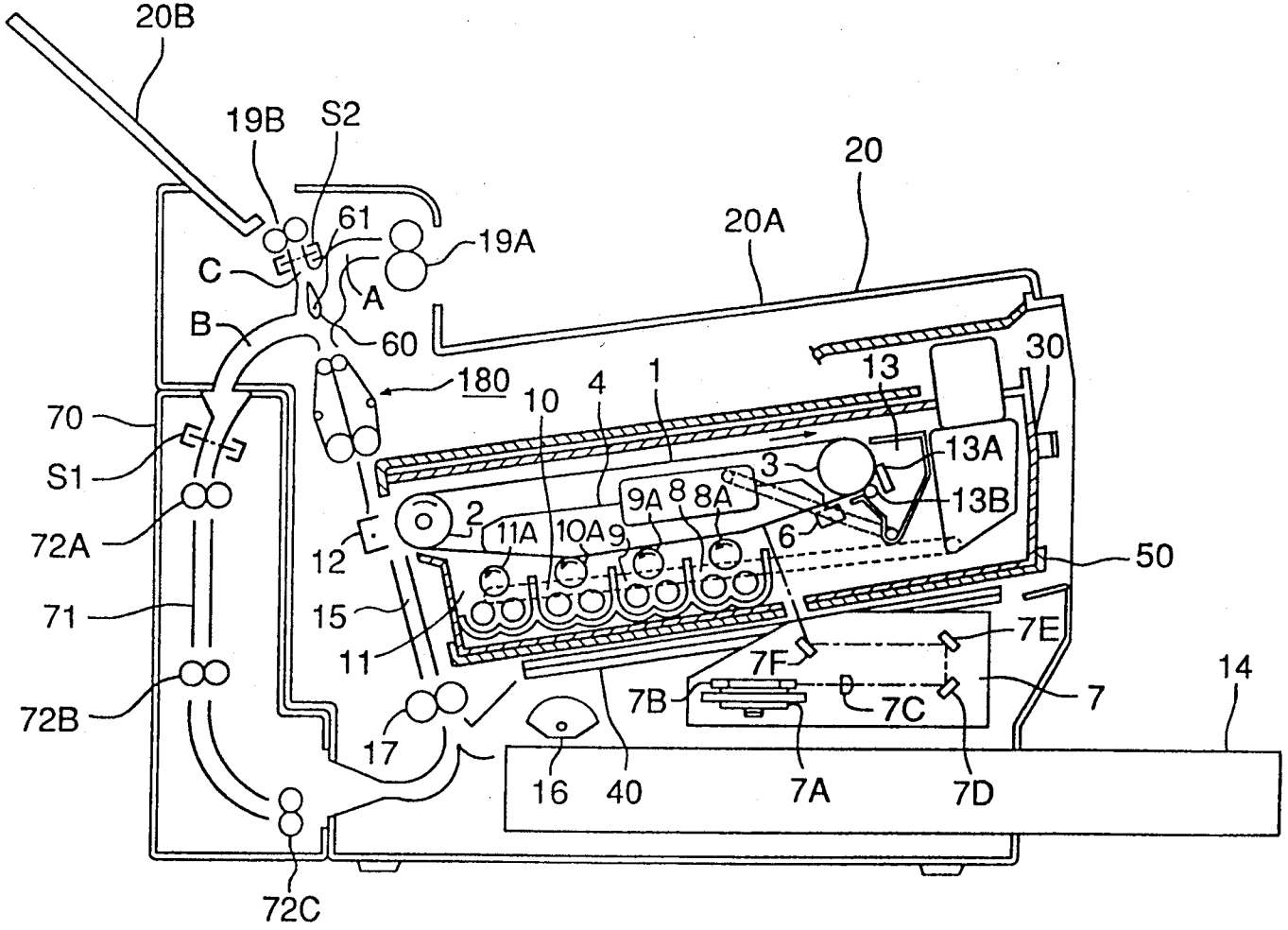
FIG. 1 is a side sectional view showing the color image forming apparatus of the present invention, and also showing an example of the conveyance means for transfer sheets.

FIG. 1 is a side sectional view showing the structure of the color image forming apparatus according to the present invention.

The photoreceptor belt 1 is flexibly wrapped around rotational rollers 2 and 3, and when the rotational roller 2 is driven in the arrowed direction, the photoreceptor belt 1 is conveyed clockwise.

The guide member 4 is fixed to the apparatus body in such a manner that the guide member 4 is brought into contact with the inside of the photoreceptor belt 1. Tension is given to the photoreceptor belt 1 when the rotational roller 3 is pushed outward. As a result of the foregoing, the inner circumferential surface of the photoreceptor belt 1 is slidably contacted with the guide member 4. Accordingly, the photoreceptor on the outer circumferential surface of the photoreceptor belt 1 is always maintained in a predetermined relation to the surface of the guide member 4. Therefore, a stable image forming surface can be provided in this apparatus.

The scorotron charger 6 is a charging means. The laser writing unit 7 is an image exposure means. The plural developing units 8 to 11 are accommodating developers of various colors. These image forming means are disposed around the outer circumferential surface of the photoreceptor belt 1, the reverse side of which is opposed to the guide member 4.

Besides the optical type laser writing unit 7 shown in the drawing, an optical type laser writing unit is also used in which a light emitting section such as an LED array and a convergent light transmitter are integrated.

The developing units 8, 9, 10, 11 respectively accommodate developers of black, cyan, magenta and yellow. The developing units are provided with developing sleeves 8A, 9A, 10A, 11A, and a gap formed between the developing sleeve and the photoreceptor belt 1 is maintained constant, so that a latent image on the photoreceptor belt 1 is visualized by means of noncontact development. This noncontact development method is different from a contact development method, and advantageous in that: a first toner image developed in a first color (e.g. yellow) on the belt does not intrude into the developing unit of a second color (e.g. magenta) when a second toner image is superimposed on the first toner image so that the toner image on the photoreceptor is not damaged; and unstable load fluctuation can be avoided when the photoreceptor belt is moved while development is carried out.

A blade 13A and a cleaning roller 13B (referred to as a roller, hereinafter) of the cleaning unit 13 are maintained in a position separate from the surface of the photoreceptor belt 1 during image formation. They are brought into pressure contact with the surface of the photoreceptor belt 1 only when a cleaning operation is carried out after image transferal.

The process of color image formation conducted by the aforementioned color image forming apparatus will be described as follows.

In this example, multicolor image formation is carried out according to the following image forming procedure. That is, an original image is optically scanned, and the obtained signal is photoelectrically converted into color image data by an image sensor. The color image data is processed in an image data processing section so that recording image data is made. The recording image data is temporarily stored in an image memory. After that, the data is read from the image memory, and outputted into a recording section such as the color image forming apparatus shown in FIG. 1.

In the manner described above, the color image data outputted from the image reading apparatus that is different from the recording section is inputted into a semiconductor laser modulation circuit of the recording section. In the laser writing unit 7, a semiconductor laser (not shown in the drawing) is driven by a modulation signal outputted from a modulation circuit so that a laser beam is generated. The laser beam is subjected to rotary scanning conducted by a polygonal mirror 7B that is driven by a drive motor 7A. The optical path of the beam is deflected by mirrors 7D, and 7E through an $f\theta$ lens 7C. Then, the beam is projected onto the circumferential surface of the photoreceptor belt 1 to which an electrical change has been previously given by a charger 6. In the manner described above, a bright line is formed on the circumferential surface of the photoreceptor belt 1.

When scanning is started, the beam is detected by the index sensor, and then beam modulation is started by the first color signal and the modulated beam scans the circumferential surface of the photoreceptor belt 1. Therefore, a latent image corresponding to the first color is formed by the primary scanning by the laser beam and the auxiliary scanning conducted by the conveyance of the photoreceptor belt 1. This latent image is developed by the developing unit 8 in which black (BK) toner is charged, so that a black toner image is formed on the surface of the photoreceptor belt. While the formed toner image is held on the surface of the photoreceptor belt, it passes under the cleaning unit 13 that is separated from the circumferential surface of the photoreceptor belt 1. Black (BK) toner is provided with the spectral characteristics that infrared rays are transmittable so that the laser beam emitted from a semiconductor can be transmitted.

The photoreceptor belt 1 is charged again by the charger 6, and then the second color signal outputted from the signal processing section is inputted into the laser writing system unit 7, so that the image signal is written on the photoreceptor belt surface to form a latent image in the same manner as the first color signal. The formed latent image is developed by the developing unit 9 in which cyan (C) toner is charged.

This cyan (C) toner is superimposed on the black (BK) toner image that has already been formed.

In the same manner, a magenta (M) toner is formed on the photoreceptor belt surface in accordance with a control signal generated by the signal processing section. The formed latent image is developed by the developing unit 10 in which magenta (M) toner is charged, so that the magenta (M) toner image is superimposed on the aforementioned toner images.

The developing unit 11 is provided with yellow (Y) toner is provided. In the same manner, a yellow (Y) toner image is superimposed on the surface of the photoreceptor belt. A DC or DC/AC bias is impressed upon the developing sleeves of the developing units 8, 9, 10 and 11, so that jumping development is carried out by the two component developer that is an image visualizing means. Accordingly, noncontact development is conducted on the photoreceptor belt 1, the base of which is grounded. In this case, noncontact development can be also conducted by one-component nonmagnetic developer.

The color toner image formed on the circumferential surface of the photoreceptor belt 1 is transferred onto a transfer sheet sent from the sheet cassette 14 through the sheet guide 15.

The uppermost transfer sheet accommodated in the sheet cassette 14 is conveyed out when the sheet supply roller 16 is rotated, and supplied to the transfer unit 12 through the timing roller 17 being timed with the image formation conducted on the photoreceptor belt 1.

A transfer sheet, on which the image has been formed, is separated from the photoreceptor belt 1 that is sharply curved around the rotational roller 2, and conveyed upward. After the toner image has been fixed by the fixing belt 180, the transfer sheet is discharged onto the tray 20A or 20B formed on the upper cover 20 through the sheet discharge roller 19A or 19B.

Alternatively, the transfer sheet on which an image has been fixed is conveyed in the following manner, the detail of which will be described in detail later: The transfer sheet is reversed by the two-side unit 70 that is a reversal unit. The transfer sheet is conveyed through the sheet guide 15, and an image is transferred onto the reverse side of the sheet. In the same manner as described above, the transferred image is fused by the fixing belt 180, and then the transfer sheet is discharged onto the tray 20A or 20B through the sheet discharge roller 19A or 19B.

After the transfer operation has been completed, the photoreceptor belt 1 is further moved, and residual toner on the photoreceptor belt 1 is removed by the cleaning unit 13, the blade 13A and roller 13B of which are brought into pressure contact with the photoreceptor surface. After the cleaning operation has been completed, the blade 13A is separated from the photoreceptor belt surface, and the roller 13*b* levels the surface of the toner accumulated on the photoreceptor belt 1. After that, the roller 13B is separated from the belt surface, and the apparatus starts the following new image forming process.

The color image forming process of the color image forming apparatus of the present invention has been described above. In this process, a full color image is formed.

In the aforementioned case, the photoreceptor belt 1, charger 6, developing units 8, 9, 10, 11, and cleaning unit 13 are integrally provided in the process cartridge 30, and the process cartridge 30 is set onto the frame 50 that slides on the guide rail 40 so that the process cartridge 30 is accommodated in the apparatus body.

Figure 2:
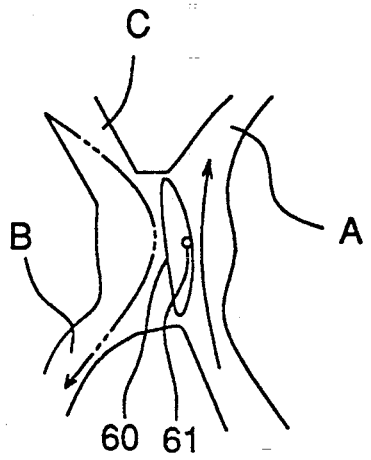
FIG. 2 is a view showing transfer sheet discharging passages of FIG. 2(*a*), FIG. 2(*b*) and FIG. 2(*c*)
Figure 2:
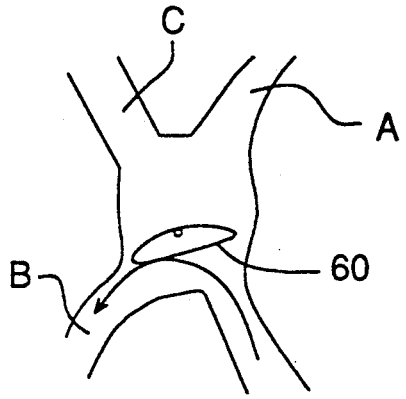
Figure 2:
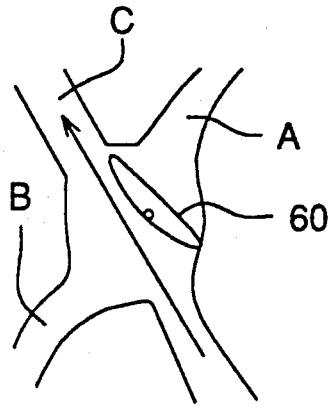

With reference to FIGS. 1 to 3, an example of the conveyance means for a transfer sheet of the color image forming apparatus of the present invention will be explained as follows.

Referring to FIG. 1, in the image forming apparatus of the present invention, the transfer sheet passage branches into passages A, B and C, and a guide member 60 is rotatably provided at the branch point of the passages.

A plurality of guide members 60 are provided on the rotational shaft 61 at appropriate intervals in such a manner that the phase is adjusted so as to be the same. The guide members 60 are rotated by a predetermined angle being controlled by the control section in accordance with a selected mode.

FIG. 2 shows each rotational position of the guide member 60, and the sheet discharge passages formed by the guide member 60.

As shown in FIG. 3, in the case where a transfer sheet is discharged face-down in the one-side copy mode, it is not necessary to set a copy mode, and the guide member 60 is always maintained at the angle shown in FIG. 2(*a*). Accordingly, the transfer sheet on which an image has been fixed passes through passage A, and is discharged onto the tray 20A provided on the upper cover 20 through the sheet discharge roller 19A.

In the case where a transfer sheet is discharged face-up, the guide member 60 is rotated clockwise from the angular position shown in FIG. 2(*a*) to the angular position shown in FIG. 2(*c*), so that the transfer sheet passes through passage C, and is discharged onto the tray 20B through the sheet discharge roller 19B.

When the two-side unit 70 is provided in which the sheet guide 71 and conveyance rollers 72A, 72B, 72C are installed, it becomes possible to conduct a superimposition copy operation in which images are superimposed on one surface of a transfer sheet, and further it also becomes possible to conduct a two-sided copy operation. In the aforementioned case, transfer sheet supply from the sheet cassette 14 is temporarily stopped.

In the case where a superimposition copy mode is selected, the guide member 60 is rotated counterclockwise from the angular position shown in FIG. 2(*a*) to the angular position shown in FIG. 2(*b*), so that a transfer sheet on which an image has been transferred, is conveyed to the two-side unit 70 through sheet discharge passage B, and the next image is transferred onto the transfer sheet after the transfer sheet has passed through the timing roller 17.

In accordance with a signal sent from sensor S1 that has detected the trailing edge of a transfer sheet, the guide member 60 is rotated from the angular position shown in FIG. 2(*b*) to that shown in FIG. 2(*a*) or FIG. 2(*c*) according to the sheet discharge condition, and then the transfer sheet is discharged onto a predetermined tray.

On the other hand, in the case where the two-sided copy mode has been selected, the guide member 60 is rotated clockwise from the angular position shown in FIG. 2(*a*) to that shown in FIG. 2(*c*), and the transfer sheet, on one side of which an image has been fixed, is conveyed into sheet discharge passage C.

In accordance with a signal of sensor S2 that has detected the trailing edge of the transfer sheet, sheet conveyance is stopped under the condition that the trailing edge of the transfer sheet is pinched by the sheet discharge roller 19B, and then the guide member 60 is rotated counterclockwise and returned to the angular position shown in FIG. 2(*a*). At the same time, the sheet discharge roller 19B is reversely rotated for a predetermined period of time so that the transfer sheet is conveyed into the two-side unit 70 through sheet discharge passage B (this system is referred to as a switchback system).

Accordingly, the reversed transfer sheet is conveyed to the timing roller 17, and the next image is transferred onto the reverse surface.

According to a signal from sensor S1 that has detected the trailing end of the transfer sheet, the guide member 60 is stopped at the rotational angle shown in FIG. 2(*a*) or rotated clockwise to the rotational angle shown in FIG. 2(*c*), so that the transfer sheet is discharged onto a predetermined tray.

When the copy mode is reset, the rotational angle of the guide member 60 automatically returns to the angle illustrated in FIG. 2 so that the apparatus is set to the normal sheet discharging condition of a one-side copy.

FIG. 3 shows the control conditions of the guide member corresponding to each copy mode.

The two-side unit 70 is detachably provided to the image forming apparatus. When the two-side unit 70 is not provided to the image forming apparatus, the superimposing copy mode and two-sided copy mode are prohibited, so that the guide member is not set at a position where the transfer sheet is conveyed to the two-side unit 70.

As described above, the conveyance means shown in FIGS. 1 to 3, can carry out one-sided recording (one-sided copy mode), two-sided recording (two-sided copy mode), as well as compound recording (superimposing copy mode). Further, the transfer sheet can be optionally discharged face-down or face-up.

Figure 4:
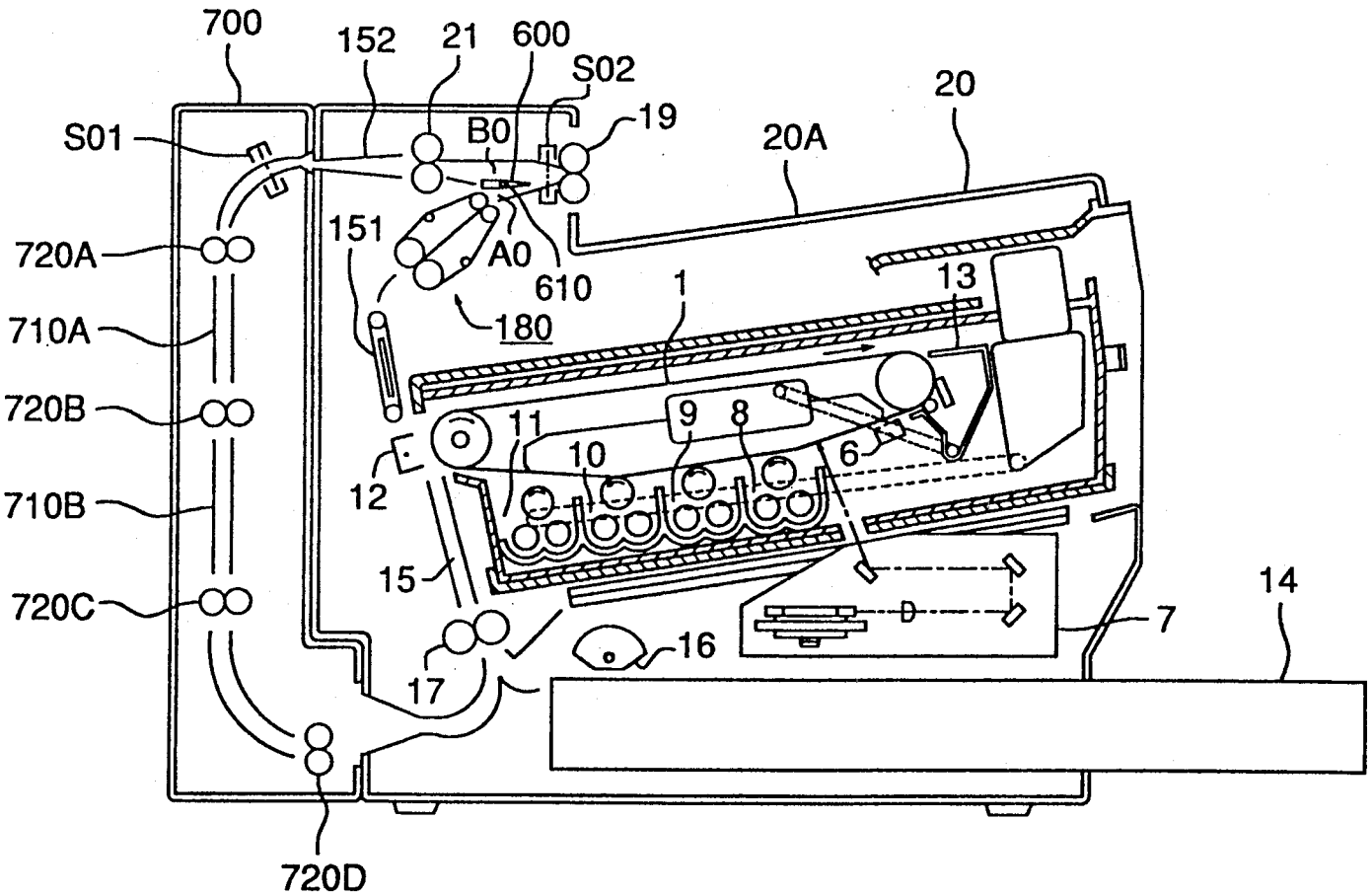
FIG. 4 is a view showing another example of the transfer sheet conveyance means of the image forming apparatus according to the present invention.
Figure 5:
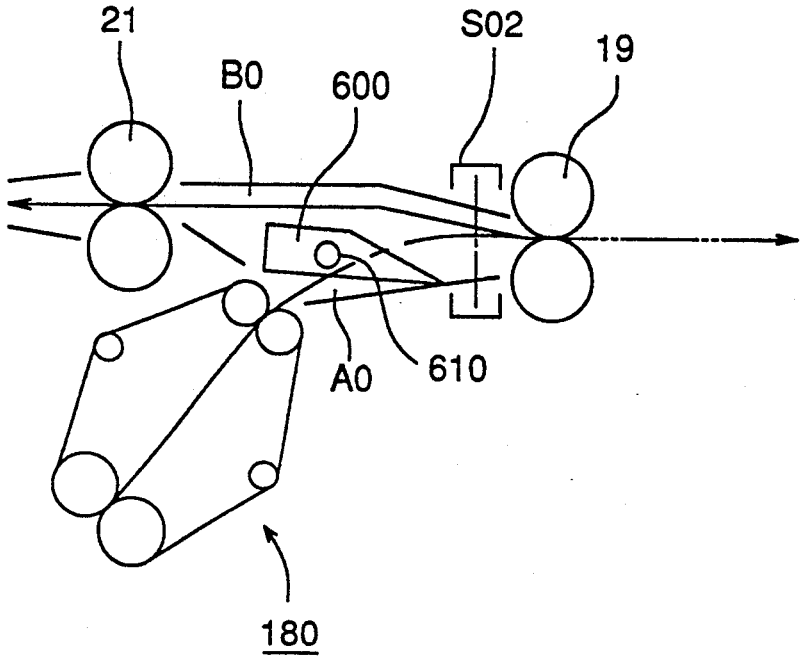
FIG. 5 is a schematic illustration of a switchback operation of a transfer sheet in the transfer sheet conveyance means shown in FIG. 4.

With reference to FIGS. 4 and 5, another example of the transfer sheet conveyance means of the color image forming apparatus of the present invention will be explained as follows.

In the image forming apparatus of the present invention illustrated in FIG. 4, transfer sheets are discharged only by sheet discharge passage AO that is a one-way passage. Separately from sheet discharge passage AO, switch-back passage BO is provided. A guide member 600 that changes over between passages AO and BO, is rotatably provided to a rotational shaft 610.

A plurality of guide members 600 are provided to the rotational shaft 610 at regular intervals in such a manner that the phase of each guide member is the same. In accordance with the selection of copy mode, the guide members 600 are rotated to a predetermined angle by the control section.

In the case of the one-sided copy mode, the guide member 600 is held at the rotational angle shown in FIG. 4. A transfer sheet onto which an image has been transferred, is conveyed upward by an attraction type conveyance belt 151. After the image has been fixed by a fixing belt 180, the transfer sheet passes through sheet discharge passage AO, and is discharged by a discharge roller 19 onto a tray 20A formed on an upper cover 20.

When a two-side unit 700 is provided including sheet feed guides 710A, 710B and conveyance rollers 720A, 720B, 720C, 720D, a two-sided copy operation can be carried out in which images can be recorded on both sides of a transfer sheet. In this case, transfer sheet supply from the sheet cassette 14 is temporarily interrupted.

In the two-sided copy mode, in the beginning stage of a copy operation, the guide member 600 is held at the rotational angle shown in FIG. 4, so that a transfer sheet, on one side of which an image has been fixed, is conveyed to the sheet discharge roller 19 through passage AO.

Although the discharge roller 19 conveys the transfer sheet in the discharging direction, the discharge roller 19 is stopped in accordance with a signal sent from sensor S02 that detects the trailing edge of the transfer sheet, under the condition that the trailing edge of the transfer sheet is pinched by the discharge roller 19. At the same time, the guide member 600 is rotated clockwise and held at the angle shown in FIG. 5, and concurrently the discharge roller 19 is reversed for a predetermined period of time. Therefore, the transfer sheet is sent to the two-side unit 700 through passage BO, conveyance roller 21 and sheet guide 152. The transfer sheet conveyed into the two-side unit 700 is conveyed to the timing roller 17 under the condition that the transfer sheet is reversed, and then the next image is formed on the reverse side of the transfer sheet.

In accordance with a signal of sensor SO1 that has detected the trailing edge of the transfer sheet, the guide member 600 is returned to the initial angle shown in FIG. 4 and held. The transfer sheet, on the reverse side of which an image has been transferred, is fixed by the fixing belt 180. The transfer sheet, on both sides of which images have been transferred, is discharged onto the tray 20A through sheet discharge passage AO and sheet discharge roller 19.

As can be understood from the above explanation, the guide member 600 is always returned to the rotational angle shown in FIG. 4 and held at that angle in the one-sided and two-sided modes.

The two-side unit 700 is detachably provided to the image forming apparatus. In the case where the two-sided unit 700 is not mounted on the apparatus, the two-sided copy mode is prohibited, so that the guide member is not set at the rotational angle shown in FIG. 5.

As explained above, when the conveyance means shown in FIGS. 4 and 5 is provided in a simple unit, it can be operated in both the one-sided and two-sided modes.

With reference to FIGS. 6 to 18, an example of the fixing means of the color image forming apparatus of the present invention will be explained as follows.

The first embodiment of the fixing unit of the present invention will be explained referring to the following drawings.

An endless belt 825 is wound around a heat roller 811, separation roller 821 and tension roller 822, wherein the heat roller 811 has a heater 814, the capacity of which is 300 W to 600 W, and preferably 400 W. The tension roller 822 can be used to control the endless belt 825 for prevention of skewing. The outside diameter of the separation roller 821 and that of the tension roller 822 are 5 mm to 20 mm. In this case, the diameter is set at 10 mm. An endless belt 825B is provided around a pressure roller 831, separation roller 821A and tension roller 822A. The pressure roller 831 pushes against the heat roller 811 through the belts 825, 825B. Air cooling units 840, 850 are respectively provided in the upper and lower portions of the belts 825, 825B between the pressure roller 831 and the separation rollers 821, 821A disposed downstream of the pressure roller. The distance from the pressure roller 831 to the separation roller 821 is 120 mm to 150 mm. In the range from the heat and pressure rollers to the separation roller, both endless belts are closely contacted with each other, and travel in the same direction, wherein a transfer sheet is pinched between the endless belts so that it can be conveyed from the entrance to the delivery port.

Figure 13:
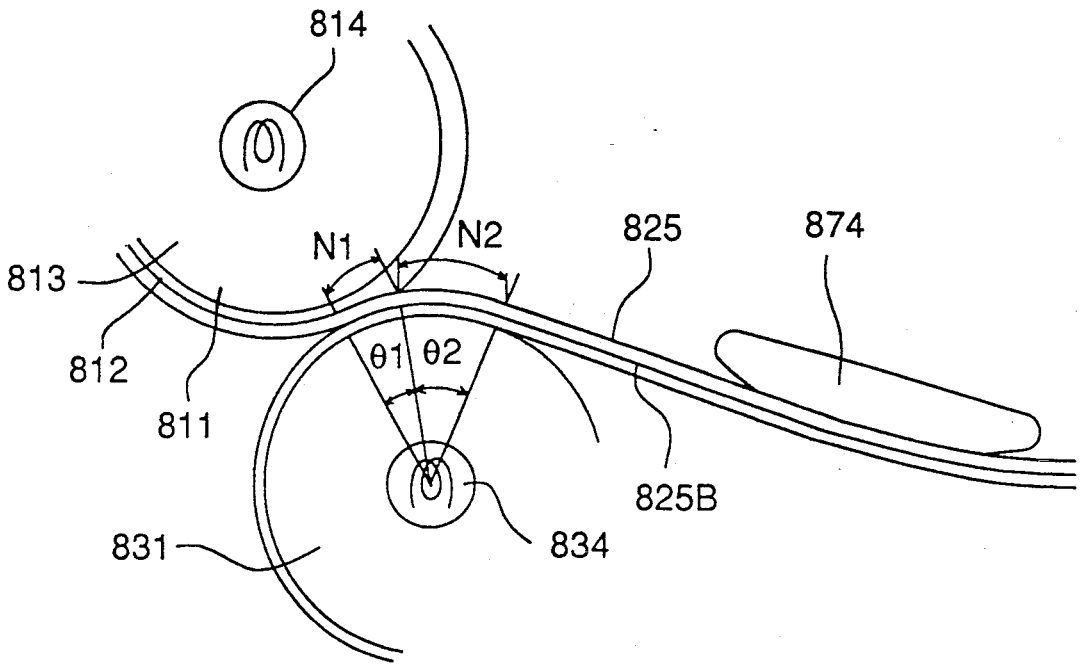
FIG. 13 is a partial sectional view of a pressure portion of another example of the fixing device of the fourth invention.
Figure 15:
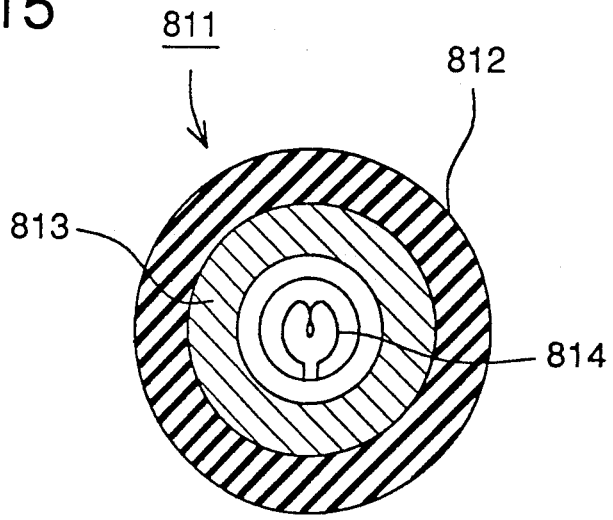
FIG. 15 is a sectional view of a heat roller of the fixing device.

As shown in FIG. 15, on the surface of the heat roller cone metal 813 there is provided a silicon rubber layer 812 that is a heat resistant synthetic rubber layer of 2 mm to 5 mm thick, and the outer diameter of the heat roller 811 is 40 mm. The heat roller 811 has a soft finish. The soft heat roller 811 is pressed by the hard pressure roller 831, so that nip region N1 is formed by angle $\theta_1$ as shown in FIG. 13. The pressure roller may be a hard roller as described above. However, it may be a soft roller, the hardness of which is higher than that of the heat roller. In that case, the rubber layer is covered with a tube made of fluorine, the thickness of which is 50 $\mu$m. In the nip region as shown in the sectional view of FIG. 13, the transfer sheet can be passed through the smooth radius of curvature of $N_1$ and $N_2$. Therefore, the fluctuation of thermal expansion of the transfer sheet can be maintained constant, so that the occurrence of wrinkles on the transfer sheet can be avoided. Also, a heater 834 is provided in the center of the pressure roller 831.

Further, with respect to the heat roller 811 or the pressure roller 831, angle $\eta_2$ is formed by the endless belts 825, 825B that are overlapped with each other, and the second nip region $N_2$ is formed. The length of the first nip region $N_1$ is preferably 3 mm to 20 mm, and more preferably 3 mm to 10 to 50 mm, and more preferably 10 mm to 35 mm.

Figure 6:
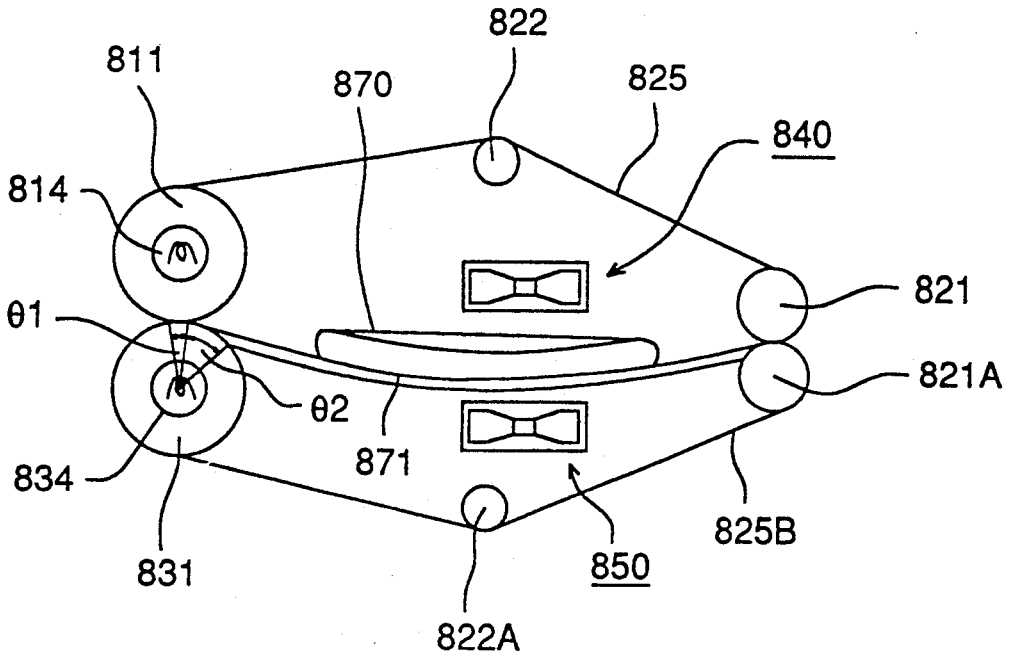
FIG. 6 is a side sectional view showing a nip region of the fixing device of the color image forming apparatus according to the present invention in the first invention.

The second nip region $N_2$ can be formed in various ways. As shown in FIG. 6, in the example of the first invention, the second nip region $N_2$ is formed in the following manner: the contact surface 871 of the press guide member 870 provided inside the heat belt 825 is brought into contact with the inner surface of the belt 825 so that both belts 825, 825B are pressed against the circumferential surface of pressure roller 831 by angle $\theta_2$. In this case, the materials of the contact surface 871 and the endless heat belt 825 are selected so that the frictional coefficient is minimized, and grooves are formed on the surface of the press guide member 870 in the belt conveyance direction in order to make the belt 825 slide smoothly.

Figure 7:
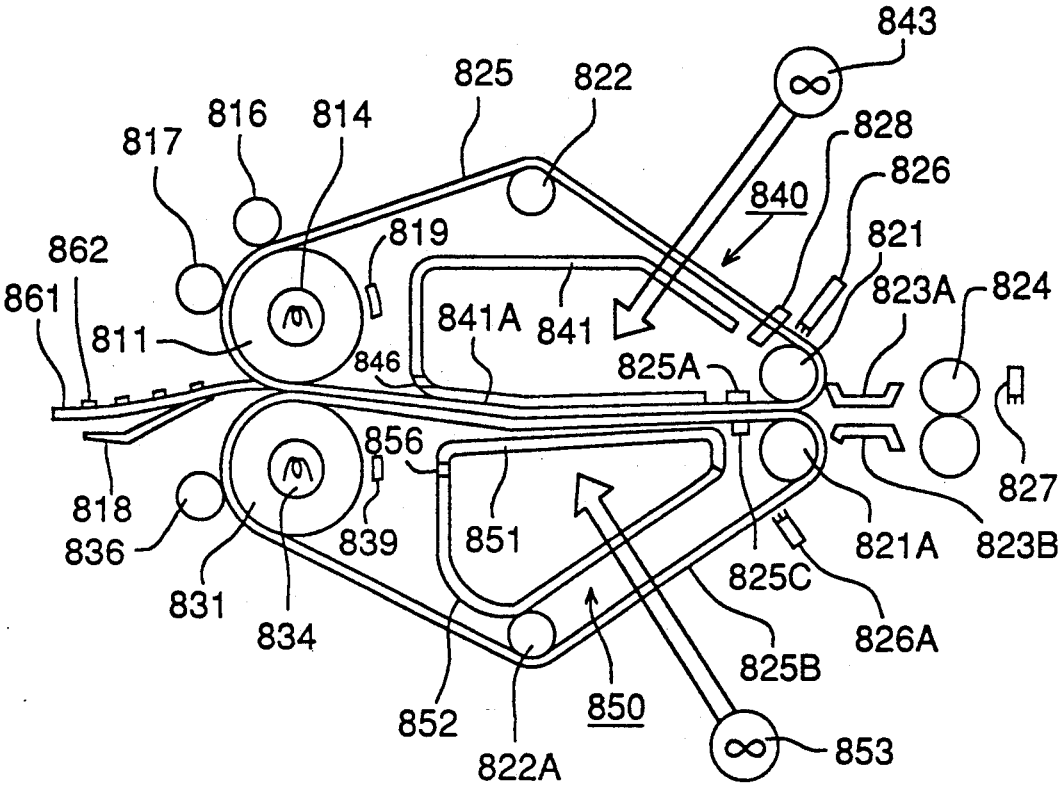
FIG. 7 is a side sectional view showing the entire apparatus of an example of the fixing device of the first invention.

As shown in FIG. 7, transfer sheet 861 carrying toner 862 is conveyed along an entry guide 818 while the transfer sheet is pinched between the endless belts 825, 825B. While the transfer sheet is conveyed, it is cooled by a guide plate 851 (FIG. 14) having louvers 857 mounted on the upper portion of an air cooling box 852 in which a fan 853 of a lower cooling unit 850 is provided, and also cooled by an air cooling box 841 in which a fan 843 of an upper cooling unit 840 is provided. The transfer sheet is separated from the belt 825 at the position where the separation roller 821 is disposed. Then, the transfer sheet is conveyed between the upper and lower guides 823A, 823B, and discharged by a pair of discharge rollers 824. As described above, the transfer sheet 861 and toner 862 are pinched by the endless belts 825, 825B, and both surfaces of the transfer sheet are cooled, so that the transfer sheet can be easily separated from the belt 825.

In the first embodiment, the contact surface 871 of the press guide member 870 can be replaced with a lower surface 841A of the air cooling box 841 of the upper air cooling unit 840 as shown in FIG. 7. That is, the air cooling box 841 is pressed against the endless heat belt 825. A large number of air circulation holes are formed on the contact surface 841A of the air cooling box 841, so that the reverse side of the endless heat belt 825 can be cooled.

A cleaning roller 816, the outer diameter of which is 20 mm, and a small-quantity-oil-disposed roller 817 are disposed in an upper position of the heat roller 811, and a cleaning roller 836 is disposed in a lower position of the pressure roller 831. These rollers are made of silicon rubber or foamed urethane rubber.

Discharging brushes 826, 826A, 827 are disposed in a position along the return belt close to the separation roller, and right after a pair of discharge rollers 824. A very small gap 856 is formed between the air cooling box 852 and the guide plate 851 having the louvers 857 in a portion of the lower air cooling unit 850 close to the pressure roller 831, and a very small gap 846 is also formed between the duct 841 of the upper air cooling unit 840 and the endless belt 825 close to the heat roller 811. Therefore, the cooling air blown to the heat roller 811 and the pressure roller 831 does not cool the roller surfaces, so that the heating efficiency is not reduced.

Temperature sensors 825A, 825C are provided on the reverse side of the endless belt in the upstream portion close to the separation roller. Temperature detection sensors 819, 839 are respectively provided close to the surfaces of the heat roller 811 and the pressure roller 831.

Figure 16:
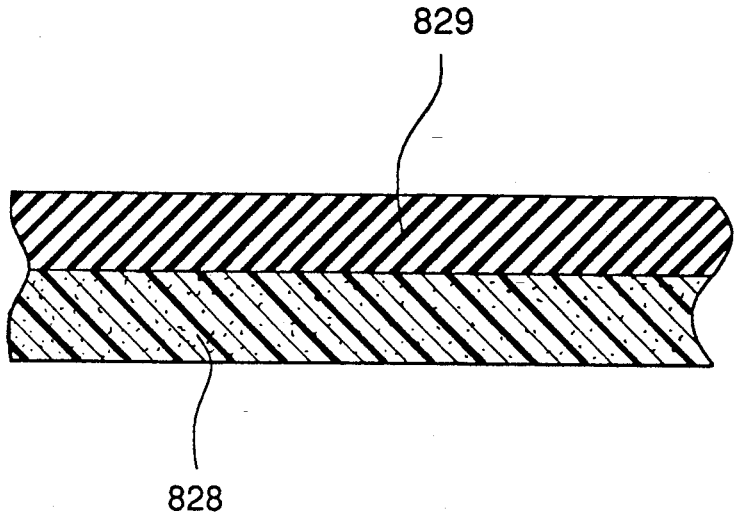
FIG. 16 is a sectional view showing the layer structure of an endless belt of the fixing device.

As shown in FIG. 16, the endless belts 825, 825B are composed of a base 828 made of transparent polyimide resin that is coated with a releasing layer 829 made of resilient silicon rubber, wherein the releasing layer 829 is provided in such a manner that it forms a smooth glossy surface like a mirror. The polyimide layer is 25 μm to 75 μm thick, and the total thickness is 25 μm to 150 μm, and the belt width is 310 mm. However, in the case of the endless pressure belt 825B, the releasing layer 829 of silicon rubber may be omitted Operation of the fixing unit arranged in the aforementioned manner will be described as follows.

Figure 17:
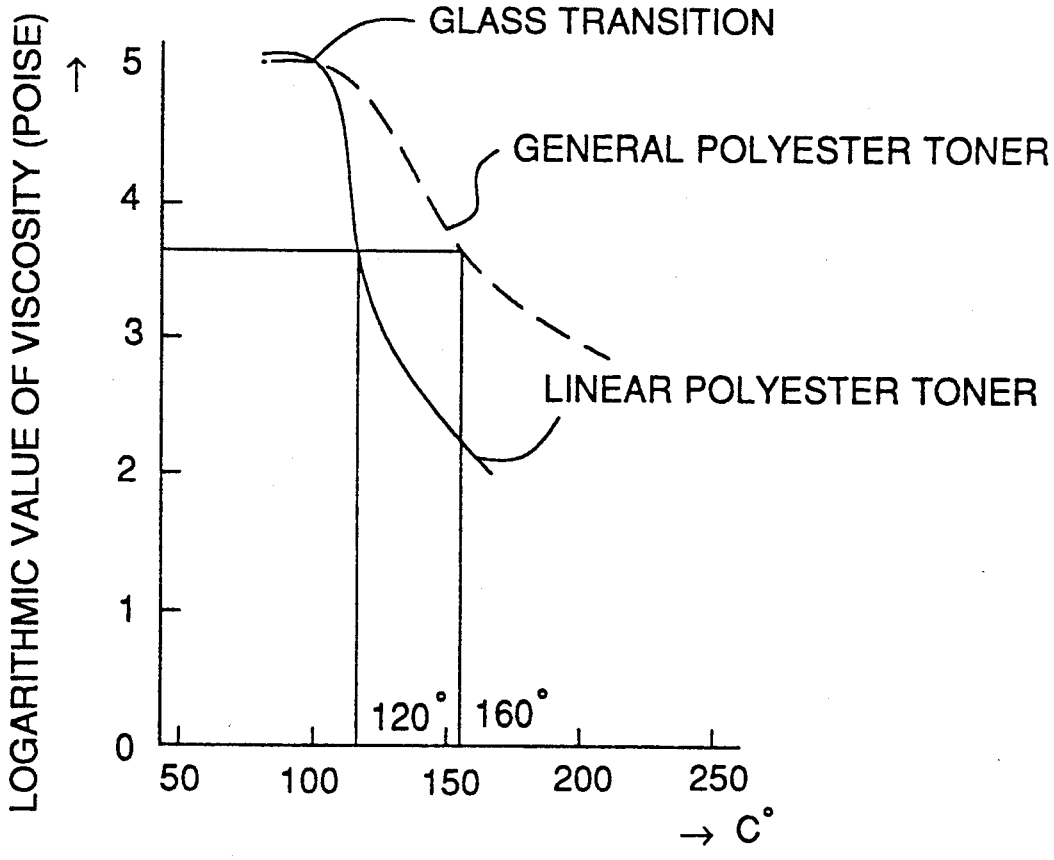
FIG. 17 is a viscosity-temperature characteristic diagram of toner in the fixing device.

First, the viscosity-temperature characteristic curves of linear polyester toner and that of common polyester toner shown in FIG. 17 are explained as follows.

On this graph, the vertical axis represents viscosity, the unit of which is poise, expressed by a common logarithm. The horizontal axis represents temperature. The characteristic curve of linear polyester toner is shown by a solid line, and that of common polyester toner is shown by a broken line. At a temperature of 100° C., the viscosities of both toners are very high, so that the toners are in the condition of glass dislocation. When the temperature exceeds 100° C., both toners are fused. The most appropriate fusing condition can be obtained when the viscosity is about 5000 poise. In the case of common polyester toner, the most appropriate viscosity can be obtained at a temperature of 150° C., however, in the case of linear polyester toner, it can be obtained at a temperature of 120° C., which is far lower than that of the common polyester toner.

Compared with a conventional fixing unit in which thermal fixing is carried out by a nip formed only by a pair of fixing rollers, the endless heat belt 825 and endless pressure belt 825B are provided between the rollers in the case of the present invention. Therefore, the temperature decreasing time can be ensured before a transfer sheet is separated from the belt. For that reason, the fusing temperature can be increased compared with the conventional case, so that the heating region can be further extended. In this heating region, an image that has not been fixed yet, can be sufficiently fused by the toner made of linear polyester that can be fused at low temperatures. By an adhesive force between the fused toner 862 and the transfer sheet 861, and also by an air flow blown against the front and reverse surfaces of the transfer sheet by the cooling fans 843, 853, the transfer sheet 861 and the toner 862 are pinched by both endless belts 825, 825B and conveyed by the belts, so that the temperature of the transfer sheet and toner is lowered by the cooling effect of the air flow.

In this region, the toner 862 is sufficiently cooled and its viscosity is greatly increased so that the toner 862 goes into a glass dislocation condition. The transfer sheet 861 on which the toner 862 has been transferred, is separated from the belts 825, 825B at the curved portion of the endless belts 825, 825B supported by the separation rollers 821, 821A. At this time, the toner 862 is in a coagulated glass dislocation condition. Since the surface of the endless heat belt 825 is smooth and glossy like a mirror surface, the toner surface becomes as smooth and glossy as the belt 825 surface. As described above, the toner 862 is coagulated after it has been sufficiently fused, so that color reproduction properties of a plurality of color toners can be ensured when they are mixed and fused, and the transmission property is stable when the toner is transferred onto an OHP sheet. Accordingly, an image of high quality can be provided. In this case, the surface of the endless heat belt 825 is made of silicon rubber that is a releasing agent, so that the surface is provided with releasing properties as well as resilience. Therefore, the toner can be given uniform pressure and heated uniformly. Further, a small damping effect can be provided by the releasing layer. Accordingly, even in the case of linear polyester toner, the fusion temperature of which is relatively low, an offset condition is not caused, or even when the offset condition is caused, its influence is so small that the offset can be removed by cleaning.

Temperature control of the heat roller 811 and pressure roller 831, around which both endless belts 825, 825B are provided, is conducted by the temperature sensors 819, 839 that are brought into contact with the outer circumferential surfaces of the rollers in such a manner that the sensors do not interfere with the belt passage. Therefore, it is very advantageous that the surfaces of the belts 825, 825B are not damaged by the temperature sensors 819, 839. Further, the belt 825 and the toner 862 are contacted with each other only on the surface of the endless heat belt 825, so that the toner does not spread onto the reverse surface of the belt. Consequently, the toner does not adhere on the sensor, so that defective detection can be avoided.

In the case of a fixing unit in which both endless belts 825, **825*b* are used, the fixing temperature tends to be affected by the conditions of the upper and lower air cooling units 840, 850. When the heating temperature is controlled by a measured value of the sensor 839 provided on the pressure roller 831, as well as a measured value of the aforementioned sensor 819**, the fixing temperature can be maintained in a stable control range.

Incidentally, a nip portion, the length of which is $N_1$, is necessary for providing uniform thermal expansion to the transfer sheet 861 so that wrinkles on the transfer sheet can be avoided, and further the nip portion is necessary for pressing and fusing the transfer sheet uniformly. When the upper side (the inside) of the endless heat belt 825 is heated, the toner 862 is positively fused on the interface between the toner 862 and the endless heat belt 825. However, if the endless belt is excessively heated, the toner 862 is spread and the toner image is damaged, and further it becomes difficult to cool the toner image appropriately.

A nip portion, the length of which is $N_2$, is necessary for improving the fixing properties in the following manner: the transfer sheet 861 is sufficiently heated to fuse the toner 862, so that the toner sufficiently permeates into the transfer sheet 861.

In order to prevent the deterioration of image quality, the toner is heated in a relatively short period of time. Therefore, it is not necessary to impress a strong force upon the nip portion. It is sufficient to fuse the toner 862, so of the endless heat belt 825 is gently heated to obtain sufficient toner adhesion.

According to the results of an experiment, it was not preferable that $N_2$ became smaller than $N_1$. When $N_2$ was far larger than $N_1$, the toner image was fused excessively, so that the quality was deteriorated. When a ratio of $N_2/N_1$ was too high, a difference between the angle on the entry side and that on the delivery side became too large. In order to ensure a sufficient area of the cooling region to cool the transfer sheet 861, the ratio of $N_2/N_1$ can not be made too high. When the ratio of $N_2/N_1$ is made too high, the apparatus can not be compact, and further the higher the ratio of $N_2/N_1$ is, the more curls and wrinkles of the transfer sheet are caused.

When $N_2$ is made too large, it is necessary to provide a high drive torque, which is undesirable.

When the ratio is set to satisfy the inequality of $1 \leqq N_2/N_1 \leqq 3$, the toner 862 sufficiently permeates into the transfer sheet so that a sufficiently glossy image can be obtained. Although the toner is sufficiently fused and a glossy toner image is obtained, offset transfer onto the endless heat belt 825 can be avoided. Accordingly, the stain on the surface of the following transfer sheet 861 caused by the offset transfer could be practically avoided, and image fixing was carried out on a high quality level.

In this case, the heater 814 is installed in the center of the inner heat roller 811. The heater 834 is also installed in the center of the pressure roller 831.

The temperature detection sensor 819 is disposed in a position on the circumferential surface of the inner heat roller 811 in such a manner that the temperature detection sensor 819 does not interfere with the movement of the endless belt 825. The temperature detection sensors 825A, 825C are disposed close to the separation roller 821 in such a manner that they are contacted with the reverse sides of the endless heat belt 825 and the endless pressure belt 825B on the upstream side. The temperature detection sensor 819 is disposed in such a manner that it is brought into contact with the circumference of the pressure roller 831. According to the information obtained by the aforementioned temperature detection sensors, the voltages impressed upon the heater 814 of the heat roller 811 and the heater 834 of the pressure roller 831 are controlled, and also the voltages impressed upon the cooling fans 843, 853 are controlled.

Since a layer of low heat conductivity is provided between the heater 814 and the sensor 819, there is a tendency that the detected temperature fluctuates. In the aforementioned condition, the surface temperature can not be practically controlled.

In order to avoid the aforementioned problems, in the case of the first example, the temperature detection sensor 819 may be omitted. In the case where the sensor 819 is provided, a sensor, the time constant of which is high, may be adopted.

According to the present invention, as shown in FIG. 13, the inner heat roller 811 is covered with the soft layer 812 made of rubber. The pressure roller 831, the surface of which is hard, is pressed by the inner heat roller 811 through the endless belts 825, 825B and the transfer sheet 861. Therefore, the soft layer of the inner heat roller 811 is depressed so that nip region $N_1$ is formed, and further nip region $N_2$ is formed by the angle provided by the pressure roller as shown in FIG. 13. Consequently, the transfer sheet 861 is conveyed while heat transmission is sufficiently conducted on the transfer sheet 861. While the transfer sheet 861 is pinched by the fixing rollers including the heat roller 811 and the pressure roller 831 through the endless belts 825, 825B, the transfer sheet 861 passes through both nip regions, so that the temperature of the transfer sheet 861 is not sharply changed after it has passed through the nip regions. In the manner mentioned above, the fixing operation of the transfer sheet 861 is completed without causing any wrinkles.

On the other hand, in the case where hard rollers are brought into contact with each other in a manner of line contact or in a manner close to line contact, rapid heating and cooling are repeated so that the roller are subjected to a rapid thermal expansion. For that reason, the transfer sheet is susceptible to wrinkles.

A circuit diagram to control the temperature in the manner described above, is shown in FIG. 18.

In the circuit, the temperature control is carried out in the following manner: The temperature detection sensors 825A, 825C are disposed close to a separation position of the endless heat belt 825 and the endless pressure belt 825B in such a manner that the sensors are brought into contact with the reverse sides of the belts. The temperature detection sensors 819, 839 are disposed being contacted with the heat roller 811 and pressure roller 831. According to the values measured by those temperature detection sensors, the voltage of the heater 834 in the center of the pressure roller 831 and that of the heater 814 in the center of the heat roller 811 are controlled so that the values measured by the aforementioned temperature detection sensors 819, 839 can be maintained in a constant region.

Control of the heater 814 is changed over by a switch SW depending on the material and size of the transfer sheet 861. If necessary, ON-OFF control is applied to the air cooling units 840, 850, and ON-OFF control is also applied to motor M to drive the endless belt.

ON-OFF control is conducted according to the state of the apparatus such as preparation, printing, and an interval between printing operations.

Figure 8:
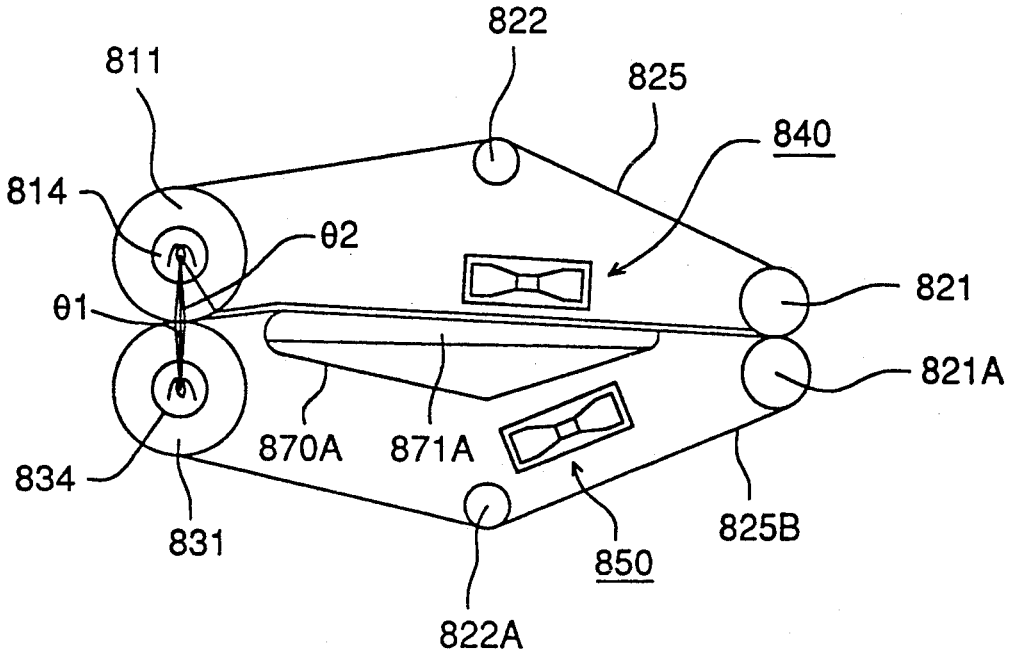
FIG. 8 is a side sectional view showing an example of the fixing device of the second invention.

The second embodiment is shown in a sectional side view of FIG. 8.

In this example, the second nip region $N_2$ is formed not around the pressure roller 831 but around the heat roller 811 in such a manner that both endless belts 825, 825B embrace the overlapped portion on the roller surface. In order to form nip region $N_2$, the device is structured in the following manner: the contact surface 871A of the press guide member 870A is pressed against the inside of the endless pressure belt 825B; the overlap portion of the endless pressure belt 825B and the endless heat belt 825 is wound around the heat roller 811 forming an embrace angle $\theta_2$ so that the second nip region $N_2$ can be provided. In this case, a frictional coefficient between the contact surface 871A and the endless pressure belt is selected to be small. Other structures are the same as those shown in FIG. 7 that is a sectional side view showing the entire construction of the first embodiment.

Figure 14:
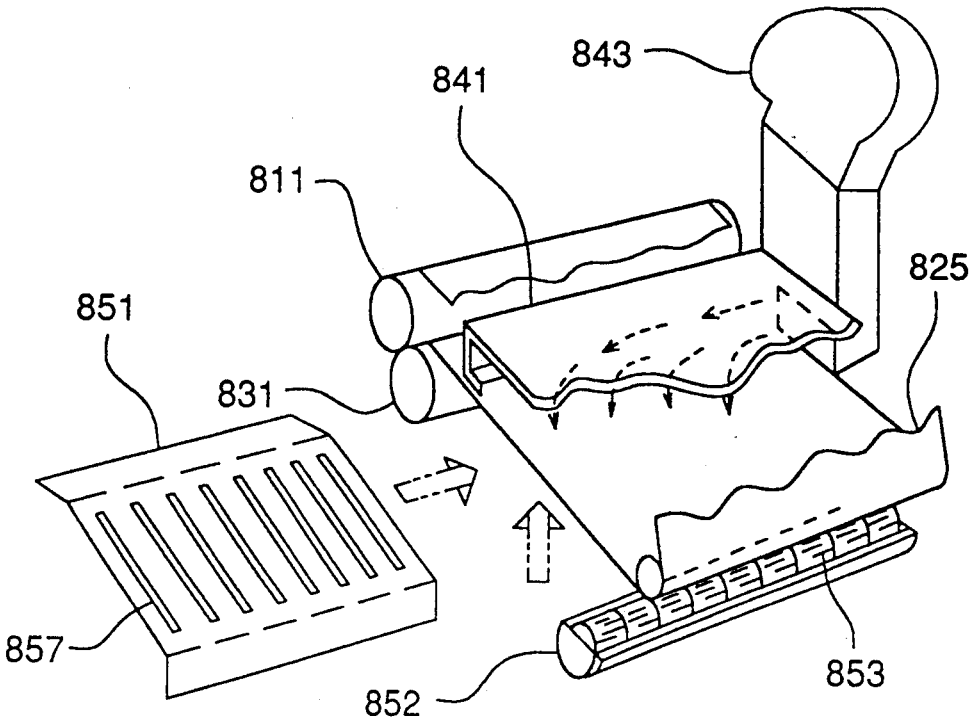
FIG. 14 is an exploded perspective view of the cooling section of an example of the fixing device.

In the second embodiment shown in FIG. 8, the contact surface 871A of the press guide member 870A can be replaced with the guide plate 851 having the louvers 857 provided on the air cooling box 852 shown in FIG. 7 or FIG. 14. The reverse side of the endless pressure belt 825B is cooled through the louvers 857.

Figure 9:
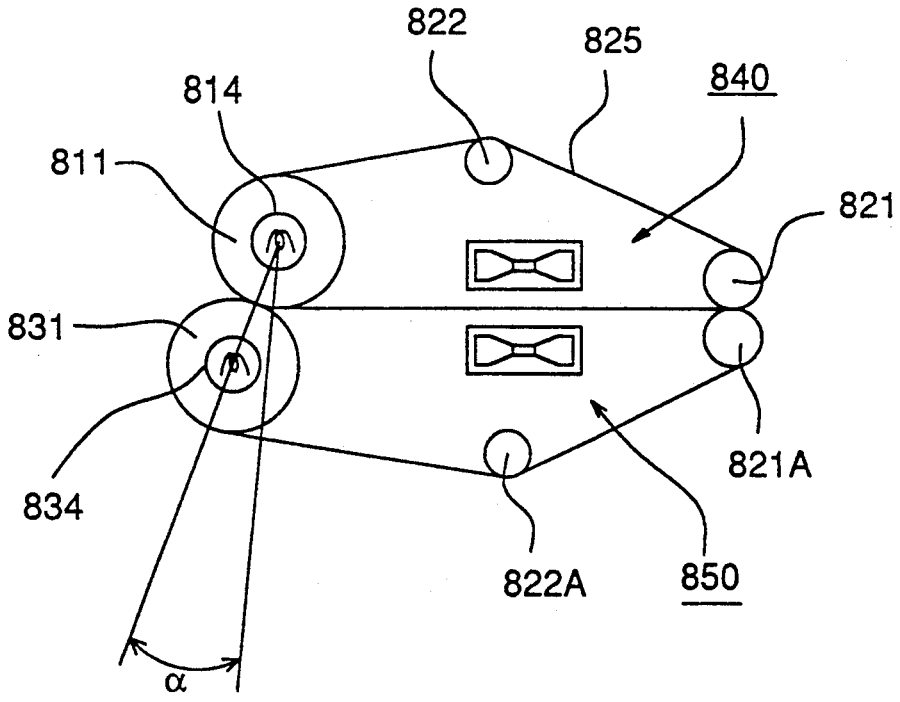
FIG. 9 is a side sectional view showing an example of the fixing device of the third invention.
Figure 10:
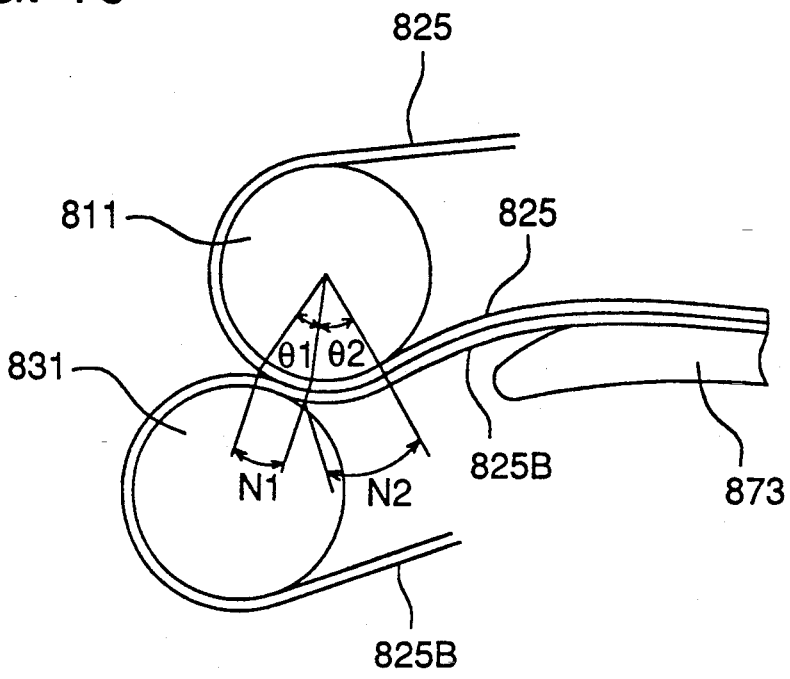
FIG. 10 is a partial sectional view of a pressure portion of another example of the fixing device of the third invention.

Next, the third embodiment will be explained referring to a sectional side view of FIG. 9 showing a nip region, and also referring to a partial sectional view of FIG. 10 showing a pressure-contact portion of the heat and pressure rollers.

This is a case in which angle $\alpha$ is formed between a straight line connecting the center of the heat roller 811 with that of the pressure roller 831, and a vertical line, and this also in a case in which the pressure roller 831 is disposed in the upstream of the conveyance direction of the transfer sheet 861.

In this example, the first and second nip regions $N_1$, $N_2$ are formed by the inclination angle $\alpha$. Other units such as a cooling unit, cleaning unit, discharging unit, temperature sensor, entry guide, upper and lower delivery guides, and discharge roller are structured in the same manner as the examples of the first and second inventions, and the functions of those units are also the same. Therefore, the explanations are omitted here. The second nip region $N_2$ is formed when the overlap portion of the endless belts 825, 825B are embraced by the heat roller 811. As a means to adjust the embracing angle $\theta_2$, the press guide member 873 is provided so that the inside of the endless pressure belt 825B can be pushed upward.

Further, when the pressure roller 831 is appropriately disposed with respect to the heat roller 811, the embracing angle $\theta_2$ is formed to embrace the heat roller by the overlap portion of both endless belt 825, 825B, so that nip region $N_2$ is formed. The length of nip region $N_1$ is preferably 3 mm to 20 mm, and more preferably 3 mm to 10 mm, and the length of nip region $N_2$ is preferably 5 mm to 50 mm, and more preferably 10 mm to 35 mm.

As a result of an experiment, it has been found that the aforementioned angle $\alpha$ is preferably 15° to 40°, and the most preferred angle is 30°.

Figure 11:
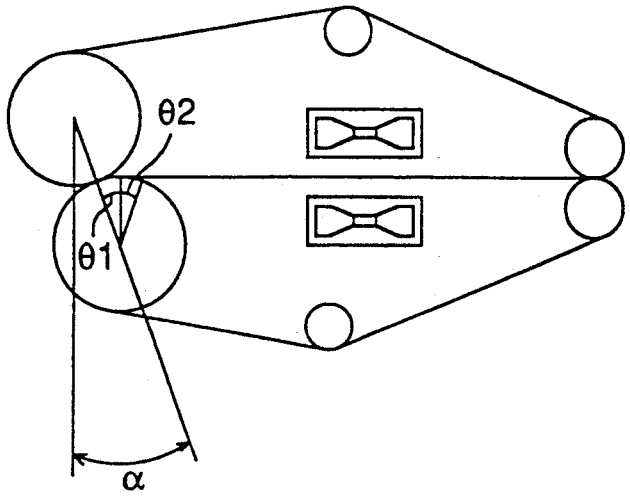
FIG. 11 is a side sectional view of an example of the fixing device of the fourth invention.
Figure 12:
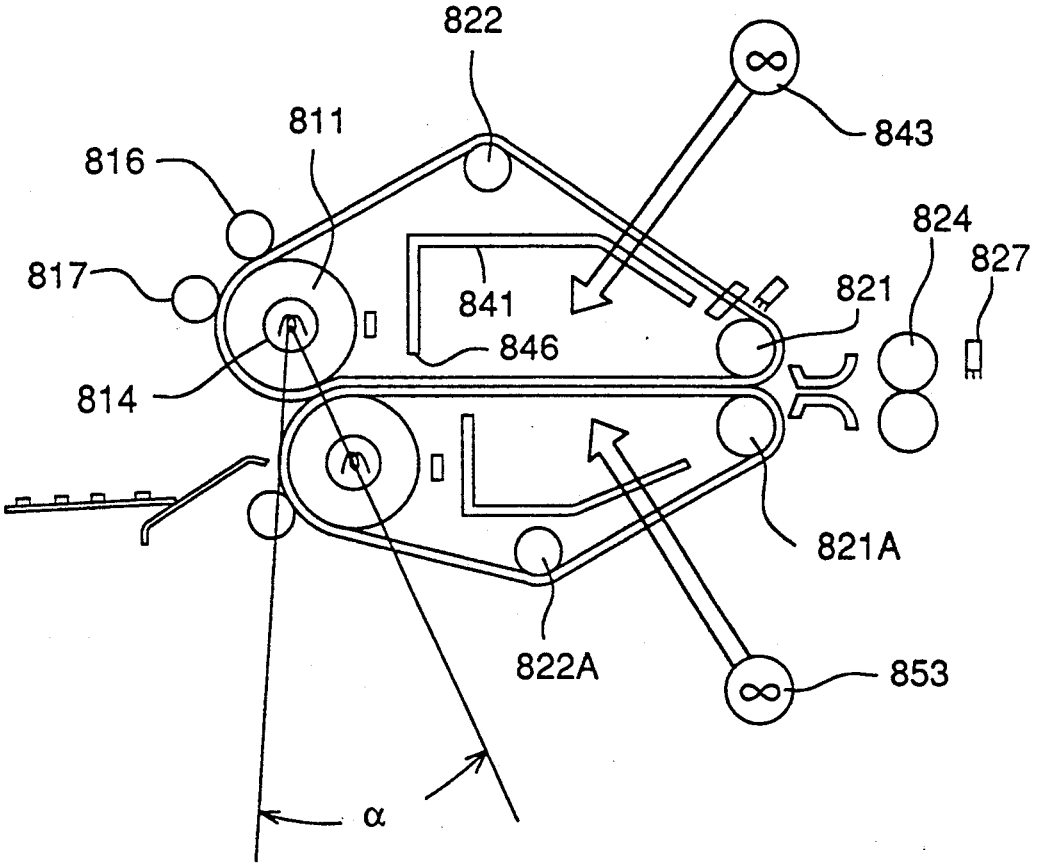
FIG. 12 is a side sectional view showing the entire apparatus of an example of the fixing device of the fourth invention.

Next, referring to FIGS. 11 and 12 that are sectional views showing the nip region, and also referring to FIG. 13 that is a partial sectional view of the pressure contact portion between the heat and pressure rollers, an example of the fourth embodiment of the invention will be explained as follows.

This is a case in which angle $\alpha°$ is formed between a straight line, connecting the center of the heat roller 811 with that of the pressure roller 831, and a vertical line; and also a case in which the pressure roller 831 is disposed in the downstream of the conveyance direction of the transfer sheet 861.

In this example, the first nip region $N_1$ and the second nip region $N_2$ are formed by inclination angle $\alpha$ in the same manner as the third invention. However, a point different from the third invention is that the second nip region $N_2$ is formed when the pressure roller 831 is embraced by both endless belts 825, 825B. Arrangements and functions of other units are the same those of the aforementioned examples.

As a means to adjust the embracing angle $\theta_2$ of the second nip region $N_2$, the press guide member 874 is provided so that the inside of the endless pressure belt 825 can be pushed downward.

Further, when the pressure roller 831 is appropriately disposed with respect to the heat roller 811, the embracing angle $\theta_2$ is formed to embrace the heat roller by the overlap portion of both endless belts 825 and 825B, so that nip region $N_2$ is formed by the endless belt 825. The length of nip region $N_1$ is preferably 3 mm to 20 mm, and more preferably 3 mm to 10 mm, and the length of nip region $N_2$ is preferably 5 mm to 50 mm, and more preferably 10 mm to 35 mm.

As a result of an experiment, it has been found that the aforementioned angle $\alpha$ is preferably 15° to 40°, and the most preferred angle is 30°.

As explained above, the first, second, third and fourth embodiments have characteristics that: the apparatus is provided with the first nip region $N_1$ formed by the heat and pressure rollers 811, 831, and also provided with the second nip region $N_2$ of the overlap portion of the endless heat belt 825 and the endless heat belt 825B formed by the pressure roller 831 or the heat roller 811.

Figure 18:
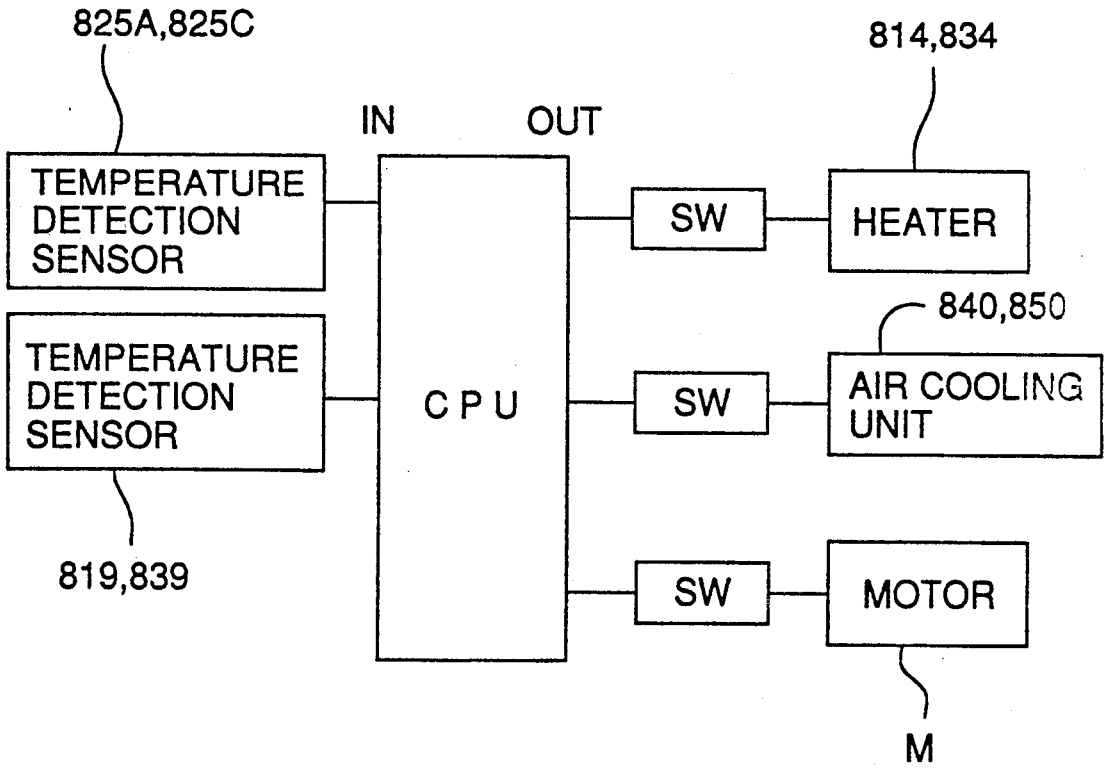
FIG. 18 is a circuit diagram of temperature control of the fixing device.
Figure 19:
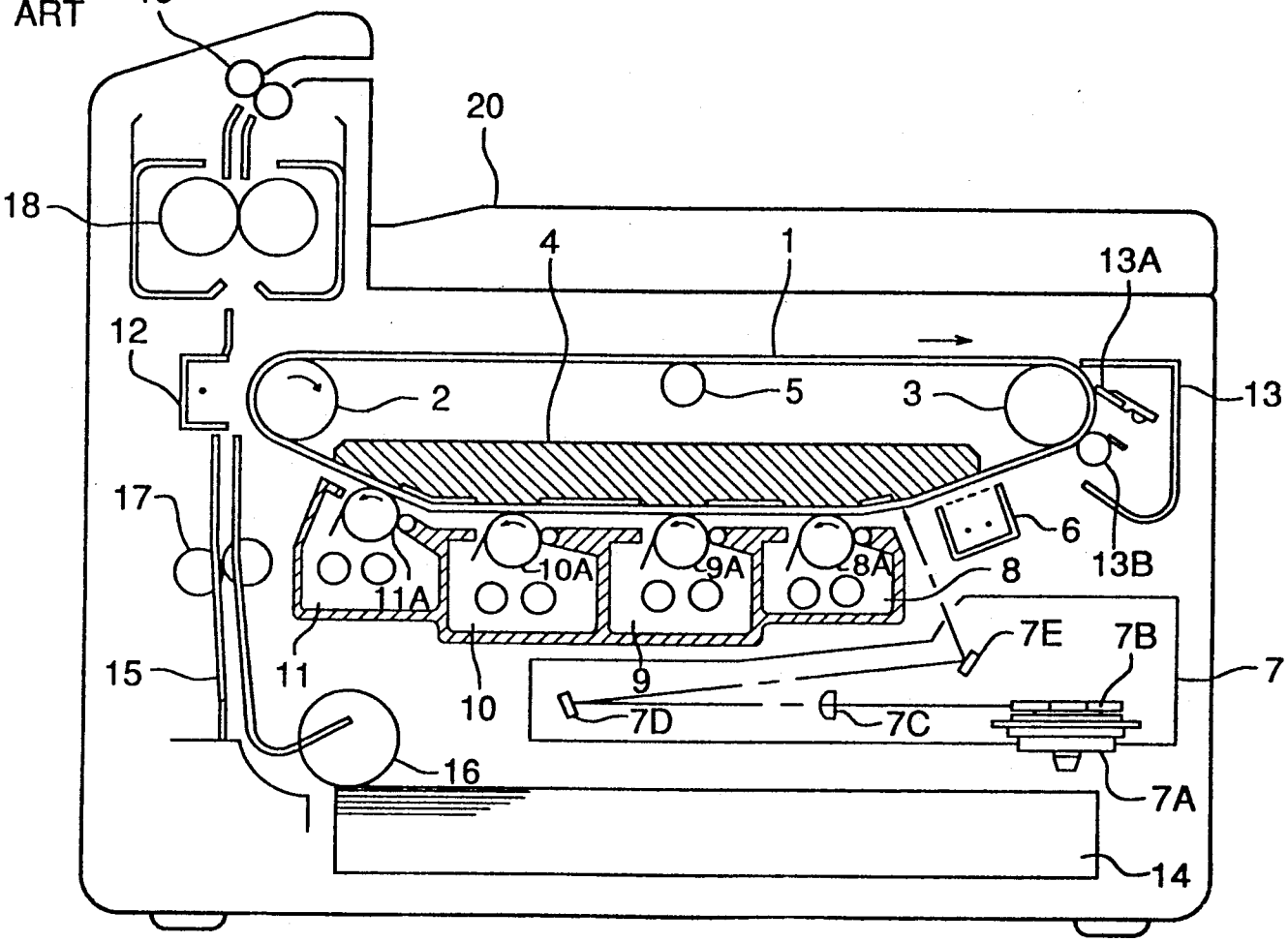
FIG. 19 PRIOR ART
FIG. 19 is a schematic illustration showing the structure of a conventional color image forming apparatus.

In each of the aforementioned embodiments, temperature control is carried out approximately in accordance with the circuit diagram shown in FIG. 18 in the same manner as the first embodiment.

According to the present invention, a simple color image forming apparatus of low cost can be provided, wherein the color image forming apparatus has the characteristic that: a color image of high quality without wrinkles and offset transfer can be stably formed irrespective of the material and thickness of a transfer sheet; and the color image can be formed on one side or both sides of a transfer sheet.

What is claimed is:

1. A color image forming apparatus for producing a toner image, corresponding to an original image, on a recording sheet, comprising:

toner image forming means for forming a toner image on a surface of a photoreceptor;

means for transferring, at a transferring position, said toner image from the surface of said photoreceptor to one of first and second opposite sides of a recording sheet;

fixing means, including an endless heat belt supported by a heat roller and a first separation roller, and an endless conveyance belt supported by a pressure roller and a second separation roller, for fixing said toner image on said recording sheet, said endless heat belt and said endless conveyance belt being partially pressed together by a first pair of rollers comprises of said heat roller and said pressure roller, and by a second pair of rollers comprised of said first separation roller and said second separation roller, said endless heat belt and said endless conveyance belt having a glossy fixing surface thereon, said first pair of rollers having its respective centers on a line which is inclined at an angle of between 15° to 40° from a line perpendicular to a plane in a direction of elongation of said belt, which plane is defined where said endless heat belt and said endless conveyance belt are pressed together, so that said first pair of rollers creates a first nip region and a second nip region, said recording sheet being nipped at said first nip region with one of said two glossy fixing surfaces facing said first side of the recording sheet and another of said two glossy fixing surfaces facing the second side of the recording sheet; and means for turning over said recording sheet after said toner image on said recording sheet is fixed by said fixing means, and conveying said recording sheet to said transferring position of said transferring means.

2. The apparatus of claim 1, further comprising means for discharging said recording sheet from the apparatus;

wherein said turning and conveying means includes means for discharging said recording sheet from said discharging means; and wherein said turning and conveying means has an unit body, and at least a part of said turning and conveying means is detachable from said apparatus.

3. The apparatus of claim 1, further comprising;

means for guiding said endless heat belt and said endless conveyance belt so that a second nip region is created.

4. The apparatus of claim 3, wherein said guiding means is pressing said endless heat belt from inside thereof.

5. The apparatus of claim 3, wherein said guiding means is pressing said endless conveyance belt from inside thereof.

6. The apparatus of claim 1, wherein said heat roller is located in front of said pressure roller in a conveyance direction of said recording sheet.

7. The apparatus of claim 1, wherein said pressure roller is located in front of said heat roller in a conveyance direction of said recording sheet.

* * * * *